US007956709B2

(12) United States Patent
Watanabe et al.

(10) Patent No.: US 7,956,709 B2
(45) Date of Patent: Jun. 7, 2011

(54) MEMS SWITCH AND MANUFACTURING METHOD THEREOF

(75) Inventors: Toru Watanabe, Matsumoto (JP); Akira Sato, Fujimi-machi (JP); Shogo Inaba, Shirojiri (JP); Takeshi Mori, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 438 days.

(21) Appl. No.: 11/832,038

(22) Filed: Aug. 1, 2007

(65) Prior Publication Data

US 2008/0035458 A1 Feb. 14, 2008

(30) Foreign Application Priority Data

Aug. 4, 2006 (JP) ..... 2006-212915

(51) Int. Cl.
*H01H 51/22* (2006.01)

(52) U.S. Cl. ..... 335/78; 200/181

(58) Field of Classification Search ..... 335/78; 200/181

See application file for complete search history.

(56) References Cited

U.S. PATENT DOCUMENTS

| | | | | |
|---|---|---|---|---|
| 6,046,659 | A * | 4/2000 | Loo et al. | 333/262 |
| 6,127,908 | A * | 10/2000 | Bozler et al. | 333/246 |
| 6,285,095 | B1 | 9/2001 | Becker et al. | |
| 6,495,387 | B2 | 12/2002 | French | |
| 7,573,695 | B1 * | 8/2009 | Walker et al. | 361/207 |
| 2001/0033196 | A1 * | 10/2001 | Lennous et al. | 327/552 |
| 2003/0058069 | A1 | 3/2003 | Schwartz et al. | |
| 2003/0116417 | A1 | 6/2003 | DeReus | |
| 2004/0017644 | A1 * | 1/2004 | Goodwin-Johansson | 361/233 |
| 2008/0123771 | A1 * | 5/2008 | Cranford et al. | 375/285 |
| 2009/0167451 | A1 * | 7/2009 | McCorquodale et al. | 331/176 |

FOREIGN PATENT DOCUMENTS

| | | |
|---|---|---|
| EP | 1 146 533 A1 | 10/2001 |
| JP | A-2003-516629 | 5/2003 |
| JP | A-2003-249157 | 9/2003 |
| JP | A-2004-200008 | 7/2004 |
| JP | A 2005-124126 | 5/2005 |
| JP | A 2005-512830 | 5/2005 |

OTHER PUBLICATIONS

Hiroshi Toshiyoshi et al., "Microelectromechanical Digital-to-Analog Converters of Displacement for Step Motion Actuators", Journal of Microelectromechanical Systems, Jun. 1, 2000, p. 218-225, vol. 9 No. 2, IEEE Service Center, Piscataway, NJ.

Gingquan Liu et al., "Micro-Electro-Mechanical Digital-to-Analog Convertor Based on a Novel Bimorph Thermal Actuator", Proceedings of IEEE Sensors 2002, Jun. 12, 2002, p. 1036-1041, IEEE, New York, NY.

* cited by examiner

*Primary Examiner* — Elvin G Enad
*Assistant Examiner* — Bernard Rojas
(74) *Attorney, Agent, or Firm* — Oliff & Berridge, PLC

(57) ABSTRACT

A micro-electro mechanical system (MEMS) switch includes a fixed electrode formed on a substrate, and a movable electric resistor formed on the substrate, the movable electric resistor serving as an electric resistor that divides an electric potential where the MEMS switch is set to a conduction state.

20 Claims, 8 Drawing Sheets

| T-TYPE | | | π-TYPE | | |
|---|---|---|---|---|---|
| ATTENUA-TION (dB) | R1 (Ω) | R2 (Ω) | ATTENUA-TION (dB) | R3 (Ω) | R4 (Ω) |
| 0 | 0.000 | — | 0 | 0.000 | — |
| 1 | 2.875 | 433.337 | 1 | 5.769 | 869.548 |
| 2 | 5.731 | 215.240 | 2 | 11.615 | 436.212 |
| 3 | 8.550 | 141.926 | 3 | 17.615 | 292.402 |
| 4 | 11.314 | 104.829 | 4 | 23.848 | 220.971 |
| 5 | 14.006 | 82.241 | 5 | 30.398 | 178.489 |
| 6 | 16.614 | 66.931 | 6 | 37.352 | 150.476 |
| 7 | 19.124 | 55.802 | 7 | 44.801 | 130.728 |
| 8 | 21.525 | 47.309 | 8 | 52.844 | 116.143 |
| 9 | 23.811 | 40.592 | 9 | 61.589 | 104.994 |
| 10 | 25.975 | 35.136 | 10 | 71.151 | 96.248 |
| 20 | 40.909 | 10.101 | 20 | 247.500 | 61.111 |
| 30 | 46.935 | 3.165 | 30 | 789.779 | 53.266 |
| 40 | 49.010 | 1.000 | 40 | 2499.750 | 51.010 |

MEMS SWITCH AND MANUFACTURING METHOD THEREOF

CROSS-REFERENCE TO RELATED APPLICATION

This application claims priority from Japanese Patent Application Serial No. 2006-212915, filed in the Japanese Patent Office on Aug. 4, 2006, the entire disclosure of which is hereby incorporated by reference in its entirety.

BACKGROUND

1. Technical Field

Some embodiments of the present invention relates to a micro-electro mechanical system (MEMS) switch and a manufacturing method thereof.

2. Related Art

A MEMS switch is a switch having a minute structure formed on a substrate made of semiconductor or the like by using semiconductor manufacturing technologies. The MEMS switch has a fixed electrode fixed on the substrate and a movable electrode having a structure such as a cantilever beam, a doubly-supported beam, a diaphragm and the like. An on/off action of the MEMS switch is performed by utilizing an electrostatic force or the like.

JP-T-2005-512830 is a first example of related art and JP-A-2005-124126 is a second example of related art. The first example discloses a MEMS switch having a movable electrode (referred to as "a flexible member" in the first example) which is made of an alloy in order to reduce an electric resistance generated when the MEMS switch is conductive. The second example discloses an application example of a MEMS switch in which the MEMS switch is used as a selector switch for selecting a radio-frequency band. In this case, an internal loss is smaller compared with a switch using a varactor diode or the like, and it is possible to obtain a high Q value (which represents resonance sharpness).

When the MEMS switch fabricated by using the technology according to the first example is applied to for example a voltage-dividing circuit, an external resistance is further needed for the voltage division since the resistance of the MEMS switch is too small. This means that the number of the components provided around the MEMS switch is increased. Accordingly, an area of a chip is expanded and a temperature difference within the chip increases. Consequently, temperature differences among resistances used in the voltage-dividing circuit become larger and differences in the resistance values of the resistances increase due to the temperature coefficient of each resistance. This deteriorates the accuracy of the voltage value that can be obtained from the voltage-dividing circuit.

When the MEMS switch is applied to a radio-frequency band by using the technology according to the second example and used to form for example an attenuator, the area where a chip occupies is increased in the same manner as the above-described case of the first example. The wave-length to which the attenuator can accommodate increases as the size of the chip which depends on the area of the chip increases. An operational frequency therefore decreases since it is proportional to the inverse of the wavelength, and this limits the operational bandwidth in a high-frequency band.

Where the MEMS is formed from a low resistance material such as alloys, the Q value which presents resonance sharpness increases and it affects largely even with a slight mismatch of the impedance. More specifically, the movable electrode of the MEMS switch serves as a short-stub when the movable electrode of the MEMS contacts with the fixed electrode. The movable electrode of the MEMS switch serves as an open-stub when the movable electrode do not contact with the fixed electrode. The amount of reflection from the short-stub or the open-stub will become large when the Q value is high, making the operation in the high-frequency band unstable.

SUMMARY

Some embodiments provide a MEMS switch with which a highly accurate operation is possible by making an increase of the area where a chip occupies and the temperature differences in the chip as small as possible, with which an application to a high-frequency band is possible by making the increase of the chip area small and with which the operation in the high-frequency band is stabilized.

A micro-electro mechanical system (MEMS) switch according to a first aspect of the invention includes a fixed electrode formed on a first face of a substrate, and a movable electric resistor formed on the first face of the substrate and serving as an electric resistor that divides an electric potential where the MEMS switch is set to a conduction state.

According to the first aspect, the electric resistance and the MEMS switch can be integrated by adopting the movable electric resistor. In this way, the number of the components provided around the MEMS switch can be reduced. The integrated circuit containing the MEMS switch can be therefore minimized in size. The parasitic capacitance and the electric coupling by the leakage inductance are made small when the size of the circuit becomes smaller. In this way, it is possible to provide the MEMS switch with which a capable wavelength which depends on the size of the circuit including the MEMS switch can be made shorter. Furthermore, electric resonance phenomena occurring at the movable electrode can be prevented because the electric resistance is imparted to the movable electrode. In this way, it is possible to control disturbance of the transmission quality particularly in a high-frequency band.

Moreover, an absolute value of the temperature difference generated in the circuit by the temperature disturbance caused by the self-heating or external heating can be made smaller compared to the hitherto known technology because the circuit in which the MEMS switch is provided occupies a smaller area compared with the hitherto known cases. By adopting the MEMS switch according to the first aspect of the invention, it is possible to curb the relative variation of the electric resistance due to the temperature differences in the chip.

The number of the MEMS switches remains the same but the switches are integrated in a small area: Therefore the resolution of the resistance value setting which depends on the number of the MEMS switches will not be decreased. Moreover it is possible to increase the number of effective chips which can be obtained from a single semiconductor substrate.

In this case, it is preferable that a projection having a strip-shape, a sword shape or a plural point contact shapes and provided in a direction aligning a normal line of a movable direction of the movable electric resistor be further formed wherein the movable electric resistor contacts with the fixed electrode.

In this way, the resistor contacts through the projection having a strip-shape, a sword shape or a plural point contact shapes so that it is possible to curb the fluctuation of the resistance value due to the variation in the contact area which is varied by the absorption power. Moreover, a larger contact area can be secured compared to the MEMS switch of a hitherto-known single point contact and it is possible to offer the MEMS switch with a reduced contact resistance.

In this case, it is preferable that a fixed electric resistor electrically coupled to the MEMS switch and the movable electric resistor be formed from an identical layer.

The resistance value of the movable electric resistor will change in the same way as the resistance value of the fixed electric resistor because the same layer is used to form these resistors. Thereby, the variation in the relative resistance value is made small though an absolute resistance value of each fixed electric resistor or each movable electric resistor or the movable electric resistor with respect to the fixed electric resistor fluctuates. In this way, it is possible to provide the MEMS switch with which a circuit having a high relative accuracy of the electric resistance and a high accuracy of the voltage division.

In this case, it is preferable that the identical layer be polysilicon.

The resistance value of the polysilicon can be changed by changing the doping amount. In this way, it is possible to select the wide range of the specific resistance value and it is possible to provide the MEMS switch which can be applied to a circuit which requires a wide range of resistance.

It is also preferable that the identical layer be a layer formed of silicide provided on the polysilicon and the polysilicon.

The sheet resistance can be further reduced by forming the silicide compared with the case where only the polysilicon is used. Therefore, it is possible to provide the MEMS switch which can make the aspect ratio of the movable electrode with respect to the application matches at a low resistance smaller and which can be easily processed.

It is preferable that the fixed electric resistor and the movable electric resistor form a voltage-dividing circuit.

When the voltage-dividing circuit is formed from the fixed electric resistor and the movable electric resistor, it is possible to change a ratio of the division by changing the setting of the MEMS switch. The movable electric resistor is the load resistance of the voltage-dividing circuit and the setting of the switch can be changed through the movable electric resistor. Thereby, it is possible to provide the MEMS switch with which the voltage-dividing circuit can be made smaller in size.

It is also preferable that the fixed electric resistor and the movable electric resistor form a gain control circuit.

Where the gain control circuit is formed from the fixed electric resistor and the movable electric resistor, it is possible to change the gain by changing the setting of the MEMS switch. The movable electric resistor is the load resistance of the voltage-dividing circuit and the setting of the switch can be changed through the movable electric resistor. Thereby, it is possible to provide the MEMS switch with which the voltage-dividing circuit can be made smaller in size.

It is also preferable that the fixed electric resistor and the movable electric resistor form at least one of an attenuator for a high-frequency signal or an impedance converter.

In this way, the movable electric resistance used in the MEMS switch becomes an open-stub or a short-stub depending on the connection/disconnection of the MEMS switch. The movable electric resistor has the electric resistance inside so that the stub with a large internal loss is formed. Accordingly, the Q value (which represents resonance sharpness) is made lower. In this way, it is possible to provide the MEMS switch which can be applied to the attenuator or the impedance converter that can reduce a peak or a notch of the high-frequency signal.

An exemplary method for manufacturing a micro-electro mechanical system (MEMS) switch having a movable electric resistor that serves as an electric resistor which divides an electric potential according to a second exemplary embodiment includes:

forming an insulating layer on an active face of a substrate, the insulating layer having an etching resistance;

forming a precursor of a supporting layer so as to cover the insulating layer, the precursor of the supporting layer having conductivity;

forming the supporting layer by patterning the precursor of the supporting layer;

forming a sacrifice insulating layer so as to cover the supporting layer;

exposing the supporting layer by forming an opening in the sacrifice insulating layer;

forming a precursor of the movable electric resistor so as to cover the sacrifice insulating layer and the exposed area of the supporting layer, the precursor of the movable electric resistor having a specific resistance value that contributes to the division of the electric potential;

forming the movable electric resistor by patterning the precursor of the movable electric resistor; and etching the sacrifice insulating layer so as to float the movable electric resistor, wherein the above-described steps are carried out in this order.

According to the method, the resistance value which decides the division of the electric potential can be imparted to the movable electrode by patterning the precursor of the movable electric resistor which has the specific resistance that contributes to the division of the electric potential. Therefore it is possible to provide the method for manufacturing the MEMS switch with which the movable electrode can serves as a movable electric resistor.

BRIEF DESCRIPTION OF THE DRAWINGS

Some embodiments of the invention will be described with reference to the accompanying drawings, wherein like numbers reference like elements.

DESCRIPTION OF EXEMPLARY EMBODIMENTS

Embodiments of the invention will be described.

First Embodiment

Figure 1:
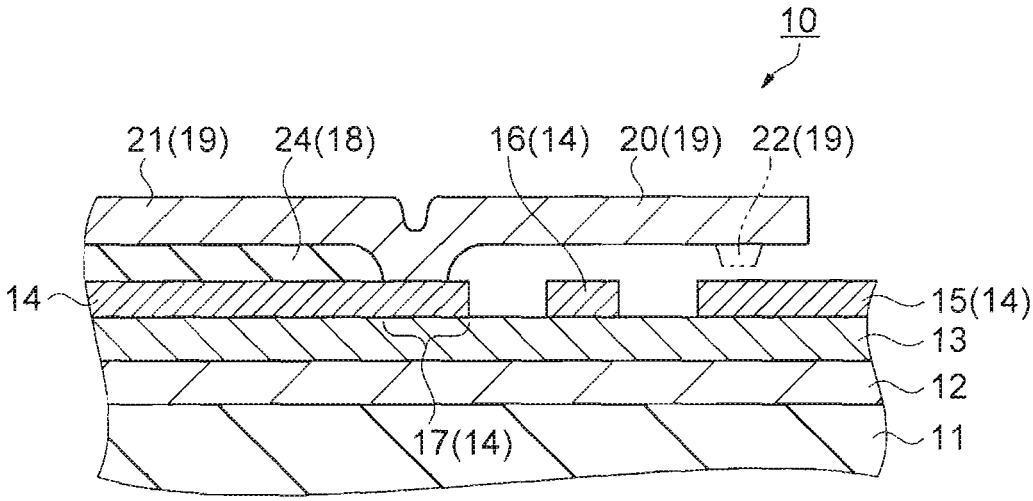
FIG. 1 is a schematic sectional view of a MEMS switch.

FIG. 1 is a schematic sectional view of a micro-electro mechanical system (MEMS) switch.

A MEMS switch 10 includes an oxide silicon layer 12 formed on a silicon substrate 11 and a silicon nitride layer 13 formed on the oxide silicon layer 12.

The MEMS switch 10 further includes a fixed electrode 15 provided on the silicon nitride layer 13, a driving electrode 16 which controls connection/disconnection of the MEMS switch 10, and a supporting member 17 that supports a movable electric resistor 20. The fixed electrode 15 is formed by etching a first polysilicon layer 14.

The movable electric resistor 20 supported by the supporting member 17 is situated between the fixed electrode 15 and the driving electrode 16 which controls the connection/disconnection of the MEMS switch 10 with certain gaps therebetween.

Here, a strip-shaped protrusion 22 can be further provided around an open end of the movable electric resistor 20. The strip-shaped protrusion 22 contacts with the movable electric resistor 20 and the fixed electrode 15, in other words, the movable electric resistor 20 is coupled with the fixed electrode 15 through the strip-shaped protrusion 22. Even when an electrostatic attraction force which is generated between the driving electrode 16 and the protrusion 22 so as to make the movable electric resistor 20 contact with the fixed electrode 15 fluctuates, the fluctuation of the contact area of the movable electric resistor 20 will be refrained in this case. This makes it possible to stabilize the contact resistance of the MEMS switch 10. The protrusion 22 can be made into any shapes such as a sword shape, a plural point contact shapes and the like other than the strip shape. By providing the protrusion 22, it is possible to secure the electric contact of the movable electric resistor 20 only with the protrusion 22 even if the electrostatic attraction force induced by the driving electrode 16 fluctuates. This helps to maintain a stable resistance value because the increase in the contact area between the movable electric resistor 20 and the fixed electrode 15 by the deflection of the movable electric resistor 20 is controlled. The MEMS switch with the protrusion 22 having the shape of strip or the plural point contact can maintain a lower contact resistance compared to the MEMS switch of a single point contact.

The movable electric resistor 20 is coupled to a fixed electric resistor 21 through the supporting member 17. According to the structure shown in FIG. 1, it is possible to form the movable electric resistor 20 and the fixed electric resistor 21 in a seamless manner by forming them from a same second polysilicon layer 19. In this way, it is possible to efficiently prevent an offset voltage which is generated by a Seebeck effect caused by a temperature rising around the seam. Furthermore, electric characteristics such as a temperature dependency of the movable electric resistor 20 can be made same as those of the fixed electric resistor 21 because these are formed of the same second polysilicon layer 19. If such MEMS switch is applied to a voltage-dividing circuit, it is possible to obtain the voltage-dividing circuit whose operation is very stable.

The fixed electric resistor 21 is provided on a filling layer 24 which is made of an electrically insulating material such as oxide silicon. Where the fixed electric resistor 21 is placed on the filling layer 24, it is possible to enhance the mechanical strength and also possible to improve reliability.

Figure 13:
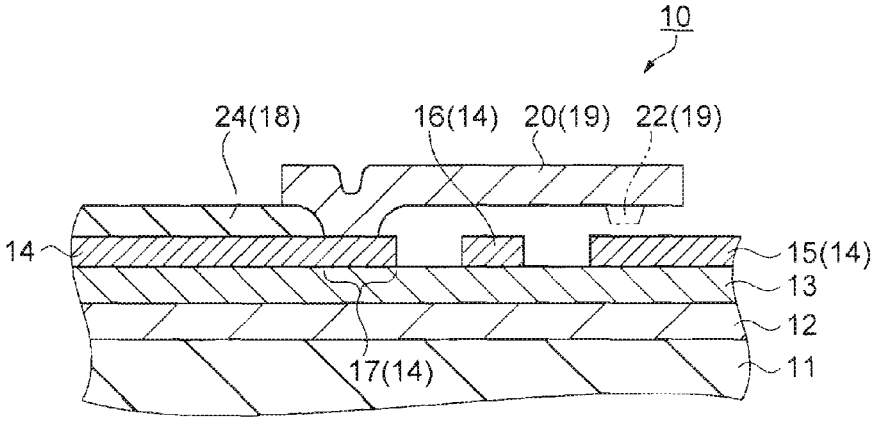
FIG. 13 is a schematic sectional view of a MEMS switch which includes a fixed electric resistance made from a first polysilicon layer 14.

Referring to FIG. 13, in stead of the above-mentioned fixed electric resistor 21, other fixed electric resistor made of for example the first polysilicon layer 14 and having the supporting member 17 as its end can be adopted. In this case, either the first polysilicon layer 14 or the second polysilicon layer 19 is used to form the fixed electric resistor so that it has more layout options compared with the above-mentioned fixed electric resistor 21 which is made only from the second polysilicon layer 19. Accordingly, an integration of the MEMS switch 10 and the electric circuit and the like can be easily carried out.

Though the fixed electrode 15, the driving electrode 16 and the supporting member 17 are simultaneously formed from the same the first polysilicon layer 14 in this embodiment, these layers may be separately formed respectively from different polysilicon layers. For example, the driving electrode 16 and the supporting member 17 can be formed from a first polysilicon layer, the fixed electrode 15 can be made from a second polysilicon layer, and the movable electric resistor 20 and the fixed electric resistor 21 can be formed from a third polysilicon layer. In this case, it is possible to reduce the risk of the short circuit between the movable electric resistor and the driving electrode 16 when the movable electric resistor is moved.

The filling between the fixed electric resistor 21 and the first polysilicon layer 14, the filling layer 24 which supports the fixed electric resistor 21 in this embodiment, is not an essential element. In a case of a high-radio frequency application, the filling layer 24 is for example removed and the air is filled there instead. In this way crosstalk due to a parasitic capacitance can be reduced because the air has a very small relative permittivity. A stable operation in the high-frequency band can be therefore realized.

Instead of the silicon substrate 11, any other substrates such as a glass substrate, a quartz substrate, a silicon-on-insulator (SOI) substrate and compound semiconductor substrates can be used provided that the substrate can withstand the manufacturing process which will be described hereunder in a second embodiment.

Moreover, silicon oxynitride can be alternatively used instead of the oxide silicon layer 12 which is provided for absorbing stress. Other materials which have a fine etching resistance can also alternatively used instead of the silicon nitride layer 13.

Though the movable electric resistor 20 is made of polysilicon in the above-described embodiment, any material with an appropriate electric resistance can be used. For example, a monocrystal silicon having a SOI structure, a amorphous silicon which is well-know for a thin film transistor (TFT) structure, and compound semiconductors such as GaAs and ZnSe can be used. Moreover, the material in which a metal silicide such as tungsten silicide is formed on polysilicon can also be used.

Though the silicon substrate 11 was adopted in the first embodiment, a substrate can be made of other materials such as a thin-film monocrystal silicon using a SIO structure, glass including quartz, compound semiconductors such as GaAs and ZnSe and the like provided that the substrate can withstand the manufacturing process which will be described hereunder in the second embodiment.

Though the MEMS switch of the cantilever beam type was described in the first embodiment, the structure described in the first embodiment can also be applied to any other types of the MEMS switch including a clamped-clamped beam type and a diaphragm type provided that the switch has a member which serves as a resistor for allocating electric potentials to the components of the switch.

Second Embodiment

A manufacturing process of the MEMS switch 10 shown in FIG. 1 will now be described as a second embodiment. FIGS. 2 through 6 are sectional views schematically showing the manufacturing process of the MEMS switch according to the second embodiment.

Figure 2:
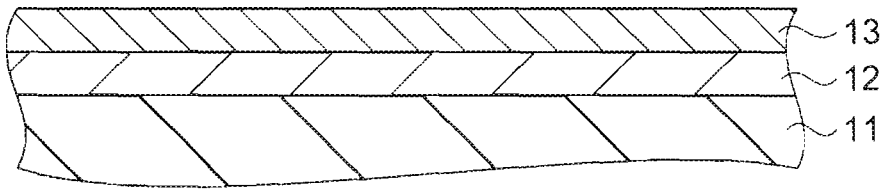
FIG. 2 is a schematic sectional view for describing a manufacturing process of the MEMS switch.

Referring to FIG. 2, the oxide silicon layer 12 which relives the stress is firstly formed on the silicon substrate 11 in Step 1 of the manufacturing process of the MEMS. Thermal oxidation, chemical deposition or the like can be used to form the oxide silicon layer. The silicon nitride layer 13 which is an insulating layer protecting the oxide silicon layer 12 from an etching solution is subsequently formed. The silicon nitride layer can be formed by for example a chemical vapor deposition (CVD) method. A glass substrate, a quartz substrate, a silicon-on-insulator (SOI) substrate and compound semiconductor substrates may be used instead of the silicon substrate 11.

Figure 3:
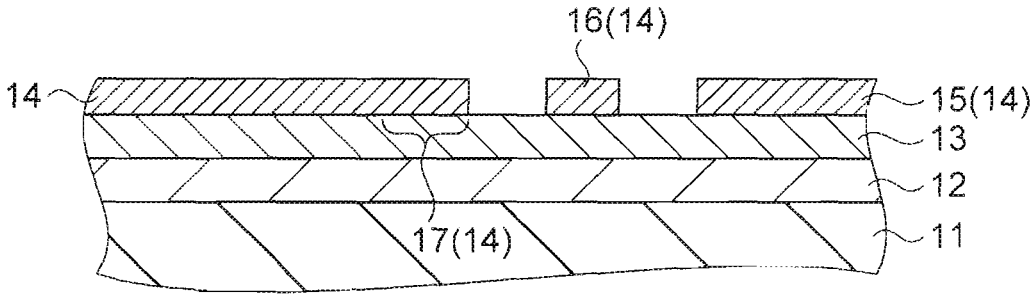
FIG. 3 is a schematic sectional view for describing the manufacturing process of the MEMS switch.

Referring to FIG. 3, the first polysilicon layer 14 which is a precursor of the supporting layer is then formed by a CVD method or the like in Step 2 of the manufacturing process. The first polysilicon layer 14 is patterned by using a photolithography method so as to form the fixed electrode 15, the driving electrode 16 which controls the connection/disconnection of the MEMS switch 10 as shown in FIG. 1, and the supporting member 17 that supports the hereinafter described movable electric resistor 20.

Figure 4:
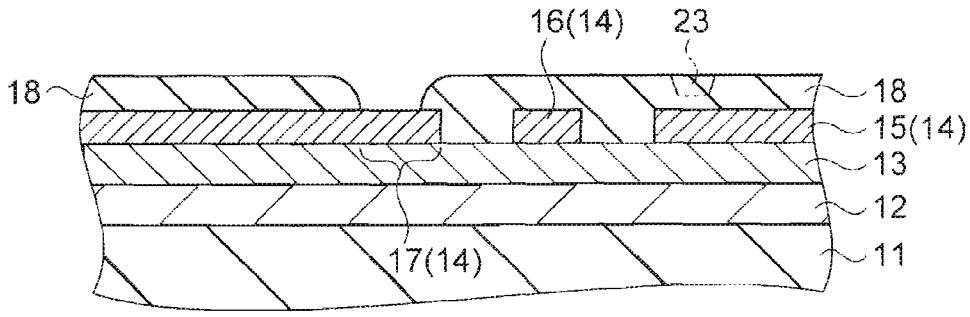
FIG. 4 is a schematic sectional view for describing the manufacturing process of the MEMS switch.

Referring now to FIG. 4, an oxide silicon layer 18 which is a sacrifice insulating layer is subsequently formed by a CVD method or the like in Step 3 of the manufacturing process of the MEMS switch. The oxide silicon layer 18 is then patterned by photolithography so as to form an opening in the oxide silicon layer 18 where covers the supporting member 17. After the oxide silicon layer 18 is formed, a groove 23 may be further formed in the oxide silicon layer 18 so as to make the hereunder described movable electric resistor 20 contact with the fixed electrode 15 in a strip form. The groove 23 can be formed by for example forming a resist-pattern by using a photolithography method and performing an etching such that the oxide silicon layer 18 is left and the first polysilicon layer 14 is not exposed by controlling the etching time.

Figure 5:
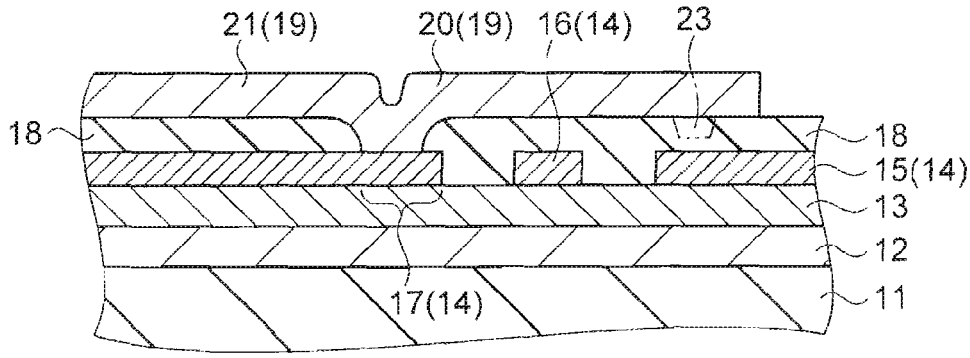
FIG. 5 is a schematic sectional view for describing the manufacturing process of the MEMS switch.

Referring to FIG. 5, the second polysilicon layer 19 which is a precursor of the movable electric resistor is formed in Step 4 of the manufacturing process. The second polysilicon layer 19 is formed so as to cover the oxide silicon layer 18 and the supporting member 17 which is made from the first polysilicon layer 14 where the opening in the oxide silicon layer 18 has been formed. The second polysilicon layer 19 is then patterned by photolithography so as to form the movable electric resistor 20 and the fixed electric resistor 21. Since the movable electric resistor 20 and the fixed electric resistor 21 are formed from the same layer, the resistance value and the temperature dependency of the resistance value of these resistors can be made substantially the same.

Silicide such as a tungsten silicide ($WSi_2$) may be further provided on the second polysilicon layer 19. The tungsten silicide is preferable because it has an etching resistance against a hereinafter-described hydrofluoric acid buffer. Such silicide structure will be preferable when a relatively low electric resistance is required for the impedance matching of a 50Ω series circuit in a high-frequency circuit. In stead of providing the silicide, the doping concentration of the second polysilicon layer 19 can be made higher so as to lower the specific resistance value of the second polysilicon layer 19. In this case, no additional step to form an additional structure is required so that the manufacturing process can be simplified.

The movable electric resistor 20 and the fixed electric resistor 21 can be made separately from a different layer respectively. In this case, freedom of the process design will be expanded. Where the groove 23 is formed in Step 3, the second polysilicon layer 19 is formed so as to fill the groove 23 formed in the oxide silicon layer 18 so that the strip-shaped protrusion 22 shown in FIG. 1 can be formed. The shape of the protrusion 22 which contacts with the fixed electrode 15 of the movable electric resistor 20 can be changed by changing the shape of the groove 23 formed in Step 3 into for example a sword shape, a plural point contact shapes or the like.

Figure 6:
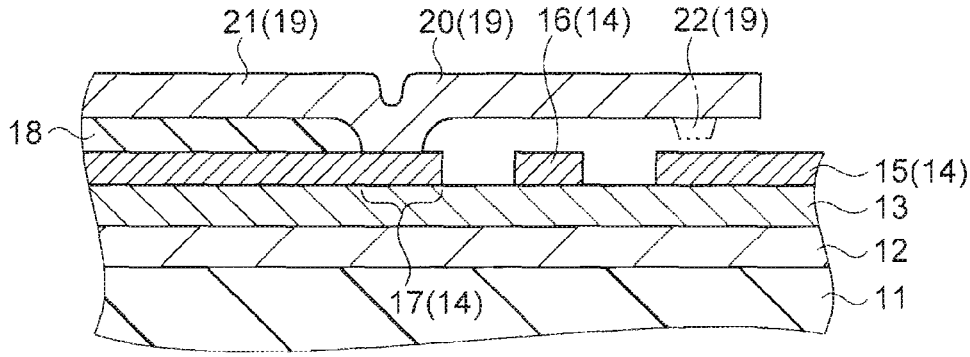
FIG. 6 is a schematic sectional view for describing the manufacturing process of the MEMS switch.

Referring now to FIG. 6, the oxide silicon layer 18 is etched by using the hydrofluoric acid buffer or the like so as to float the movable electric resistor 20 in Step 5. If a resist mask is formed on a place where the fixed electric resistor 21 is going to be formed at this point, it is possible to leave the oxide silicon layer 18 which supports the fixed electric resistor 21. This makes it possible to obtain a mechanically stable structure. The resist mask is not necessarily formed so as to leave the oxide silicon layer 18 supporting the fixed electric resistor 21 but may be formed so as to float the movable electric resistor 20. In a case of a high-radio frequency application, the filling layer 24 (see FIG. 1) is for example removed and the air is filled there instead and the relative permittivity can be lowered. In this way crosstalk due to a parasitic capacitance can be reduced and a stable operation in the high-frequency band can be realized.

By employing the above-described manufacturing method, it is possible to provide the MEMS switch 10 including the movable electric resistor 20 which has the complicated structure.

Third Embodiment

Figure 7A:
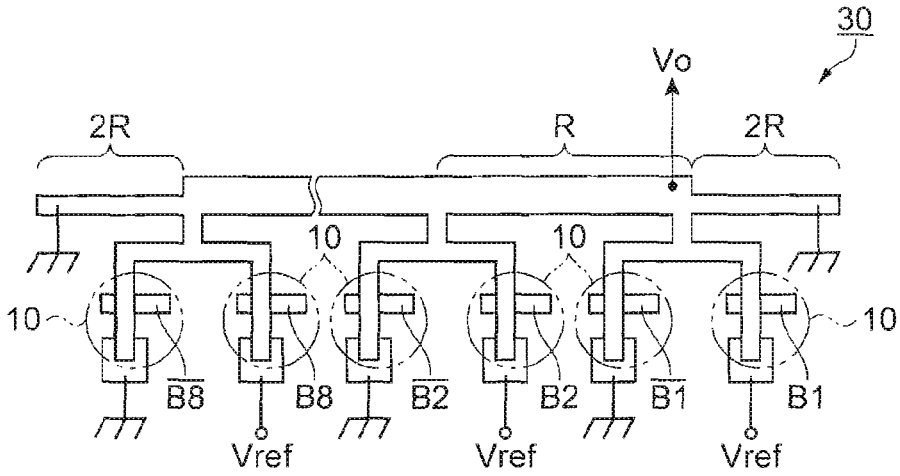
FIG. 7A is schematic plan view of a voltage-dividing circuit which is formed by using the MEMS switch.
Figure 7B:
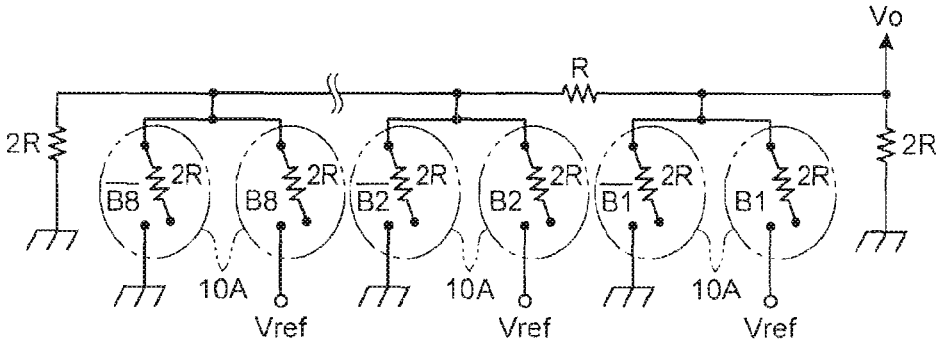
FIG. 7B is equivalent circuit schematic diagram of the voltage-dividing circuit.

A voltage-dividing circuit using the MEMS switch will be now described as a third exemplary embodiment. FIG. 7A is schematic plan view of a voltage-dividing circuit 30 which is formed by using the MEMS switch 10. FIG. 7B is equivalent circuit schematic diagram of the voltage-dividing circuit 30. The reference numeral "10A" in FIG. 7B denotes an equivalent circuit of the MEMS switch 10.

The voltage-dividing circuit 30 has a resolution of 8-bit and an output voltage is represented by the following formula:

$$Vo=Vref\times(1/3)\times(B1/2^0+B2/2^1\ldots+B8/2^{(8-1)})$$

Wherein Vref is an applied voltage, a most significant bit (MSB) is B1 and a least significant bit (LSB) is B8. It supposes that B1–B8 is "1" when they are coupled in the Vref side and B1–B8 is "0" when they are coupled in the ground side.

The accuracy of the voltage division by the voltage-dividing circuit 30 is dependent on the fluctuation of the resistance ratio. However, the accuracy will be not affected when each resistance value fluctuates at equal rate. This is because the ratio of the voltage division by the resistance is represented by the following formula:

$$Vdiv=Vin\times R1/(R1+R2)$$, where $R1$ and $R2$ are resistors used for the voltage division.

Assume that both the resistance values of R1 and R2 are increased 10%, the ratio of the voltage division is changed and will be as presented by the following formula:

$$Vo=Vin\times R1\times 1.1/(R1\times 1.1+R2\times 1.1)$$

The ratio represented by the original formula can be obtained by dividing the denominator and the numerator of the above formula by 1.1. This shows that the ratio of the voltage division will not change when the resistance values vary in the same proportion.

In this third embodiment, the movable electric resistor 20 and the fixed electric resistor 21 are simultaneously formed from the second polysilicon layer 19 by using the same mask as described in the second embodiment. Accordingly, the error of the resistance will not arise from misalignment of the mask and the like. The voltage-dividing circuit having a high accuracy can be therefore formed.

The resistance value of the movable electric resistor 20 will change in the same way as the resistance value of the fixed electric resistor 21 according to a temperature change and the like because the same layer is used to form these resistors to form the voltage-dividing circuit. Thereby, the variation in the resistance ratio is made small though each resistance value fluctuates. In this way, it is possible to obtain the voltage-dividing circuit 30 in which the occurrence of the error caused by variation in the ambient temperature and the like is prevented.

The voltage-dividing circuit 30 is formed from the identical second polysilicon layer 19 so that seams at joints of other semiconductor or conductive material do not exist in the voltage-dividing circuit 30. A thermo-electromotive force by the Seebeck effect will not be generated in such voltage-dividing circuit even if a slight temperature distribution is produced in the voltage-dividing circuit 30. This means that an offset voltage is not generated and this improves the accuracy of the voltage division especially in a low-voltage range.

Though the voltage-dividing circuit 30 is formed from the single layer in this embodiment, the structure of the voltage-dividing circuit is not limited to this. For example, instead of the fixed electric resistor 21 which uses the second polysilicon layer 19, the first polysilicon layer 14 can be used form the fixed electric resistor. In this case, either the fixed electric resistor 21 or the fixed electric resistor 21 can be selected as the resistance element depending on the situation. It follows that the freer layout is possible and this facilitates the mix layout mounting of the voltage-dividing circuit 30 and other devices.

Fourth Embodiment

Figure 8A:
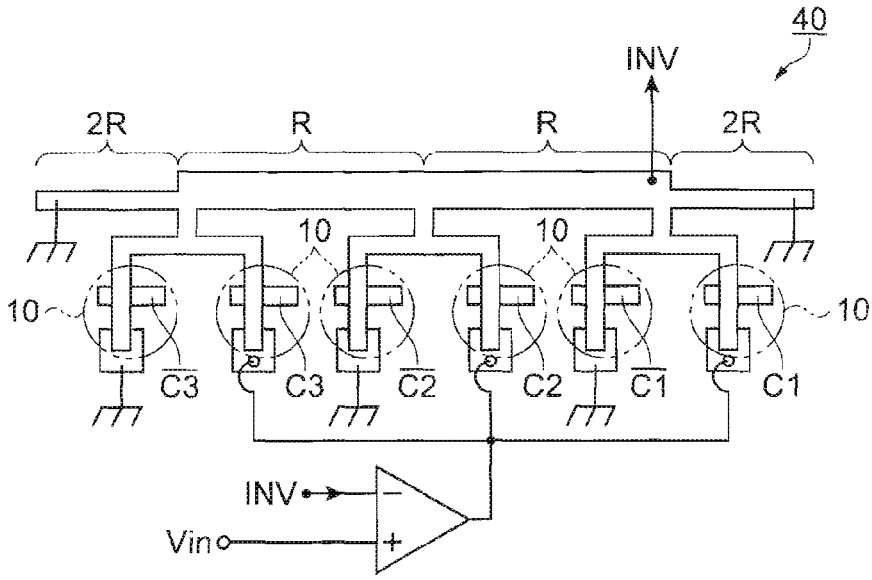
FIG. 8A is a schematic plan view of a variable gain circuit including a non-inverting input circuit which is formed by using the MEMS switch.
Figure 8B:
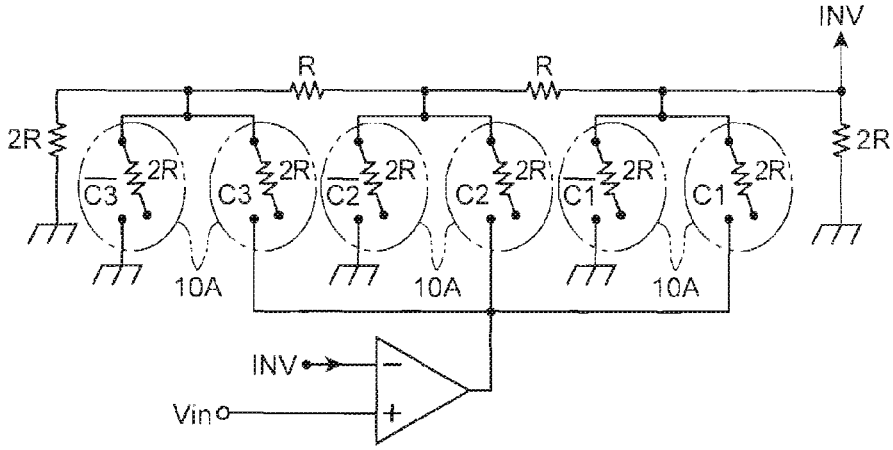
FIG. 8B is an equivalent circuit schematic diagram of the variable gain circuit.

A variable gain circuit using the MEMS switch will be now described as a fourth exemplary embodiment. FIG. 8A is a schematic plan view of a variable gain circuit 40 including a non-inverting input circuit which is formed from the MEMS switch 10. FIG. 8B is equivalent circuit schematic diagram of the variable gain circuit 40. The reference numeral "10A" in FIG. 8B denotes an equivalent circuit of the MEMS switch 10. Two "INV"s shown in FIG. 8A and FIG. 8B are coupled each other. The variable gain circuit 40 has a resolution of 3-bit and a voltage gain AV1 is represented by the following formula:

$$AV1=3/([C1/2^0]+[C2/2^1]+[C3/2^2])$$

wherein a most significant bit (MSB) is C1 and a least significant bit (LSB) is C3. It supposes that C1–C3 is "1" when they are coupled to the output side and C1–C3 is "0" when they are coupled to the ground side.

The same combination of the resistances is further added to the circuit in order to increase the bit number. The adjustment range of the gain can be expanded to the exponential of the number of the combination.

Figure 9A:
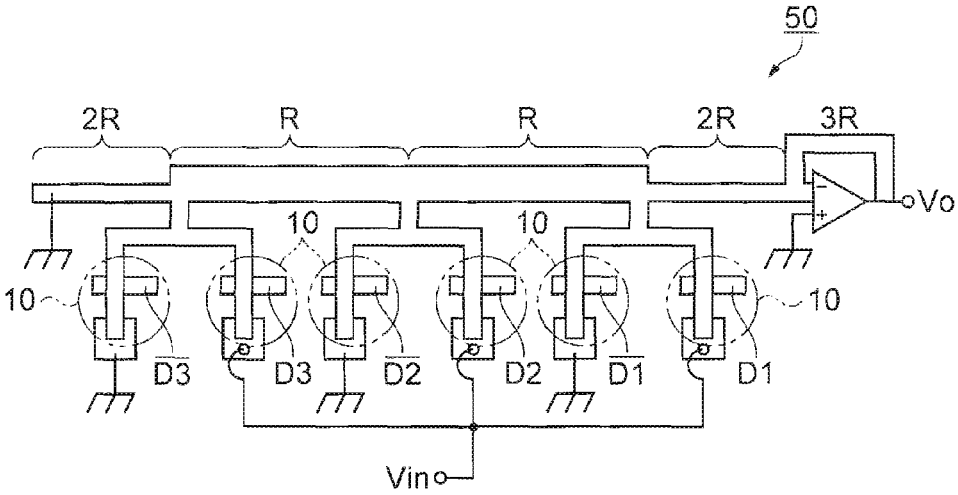
FIG. 9A is a schematic plan view of an inverting-input type amplifier circuit using the MEMS switch.
Figure 9B:
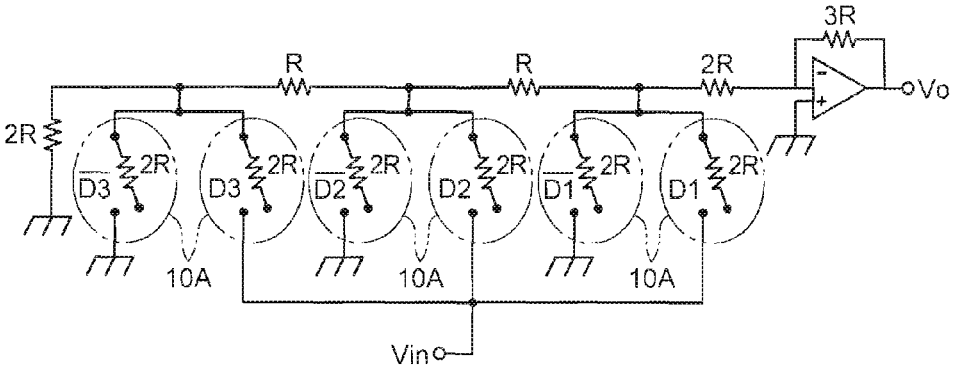
FIG. 9B is an equivalent circuit schematic diagram of the inverting-input type amplifier circuit.

The variable gain circuit can also be used as an inverting input type. FIG. 9A is a schematic plan view of an inverting-input type amplifier circuit 50 using the MEMS switch 10. FIG. 9B is equivalent circuit schematic diagram of the inverting-input type amplifier circuit 50. In this embodiment, resistors which are coupled in series with the input signal are controlled among the feedback resistors. A voltage gain AV2 of the amplifier circuit is represented by the following formula:

$$AV2=(D1/2^0+D2/2^1+D3/2^2)$$

wherein MSB is D1 and LSB is D3. It supposes that D1–D3 is "1" when they are coupled to the output side and D1–D3 is "0" when they are coupled to the ground side.

In the same manner as the above-mentioned gain circuit, the same combination of the resistances is further added to the circuit in order to increase the bit number. The adjustment range of the gain can be expanded to the exponential of the number of the combination. Other characteristics of the circuit are the same as those of the third embodiment, and the stability in the voltage gain, the control of the offset voltage, the fixed electric resistor and the like can be treated in the same manner as the third embodiment.

Fifth Embodiment

Figure 10A:
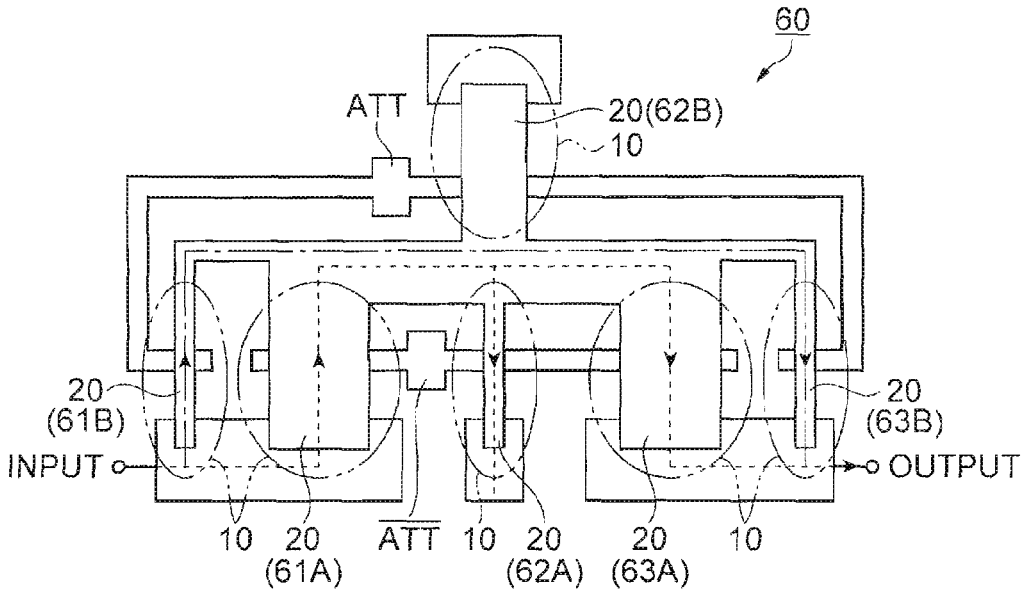
FIG. 10A is a schematic plan view of a T-type variable attenuator including the MEMS switch.
Figure 10B:
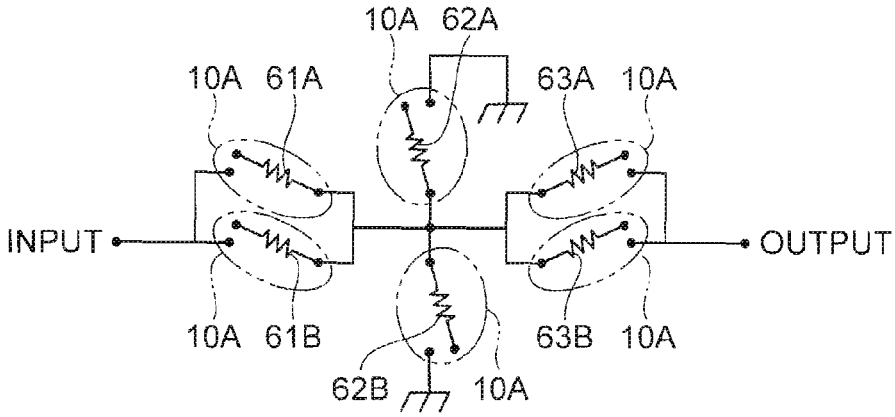
FIG. 10B is an equivalent circuit schematic diagram of the T-type variable attenuator.

A T-type variable attenuator for a high-frequency signal which uses the MEMS switch will be now described as a fifth exemplary embodiment. FIG. 10A is a schematic plan view of a T-type variable attenuator 60 including the MEMS switch 10. FIG. 10B is an equivalent circuit schematic diagram of the T-type variable attenuator 60. The reference numeral "10A" in FIG. 10B denotes an equivalent circuit of the MEMS switch 10.

A control signal with a positive phase and a control signal with an inversed phase are supplied to "ATT" and "ATT-bar" respectively. The "ATT-bar" is "1" (ON) when the "ATT" is "0" (OFF). In this case, the inputted signal travels through the path designated by the dashed line shown in the drawing and is transmitted to the output.

The inputted signal is transmitted through the following path: the input→the movable electric resistor 20 (a resistor 61A)→a part of the signal diverges into the movable electric resistor 20 (a resistor 62A)→the movable electric resistor 20 (a resistor 63A)→the output. In this case, the movable electric resistor 20 (the resistor 61A) and the movable electric resistor 20 (the resistor 63A) become wide, and the movable electric resistor 20 (the resistor 62A) becomes narrow. Thereby the loss by the divergence is small. The signal inputted from the input can be transmitted to the output with a small loss. Referring to FIG. 10B, the resistor 61A, the resistor 62A and the resistor 63A are electrically coupled and a resistor 61B, a resistor 62B and a resistor 63B become electrically open. The power is transmitted from the input through the resistor 61A and the resistor 63A to the output. The power is partially diverged through the resistor 62A and causes a loss of the electric current.

When the "ATT" is "1" (ON) and the "ATT-bar" is "0" (OFF), the inputted signal travels through the path designated by the alternate long and short dashed line shown in the drawing and is transmitted to the output. The inputted signal is transmitted through the following path: the input→the movable electric resistor 20 (the resistor 61B)→a part of the signal diverges into the movable electric resistor 20 (the resistor 62B)→the movable electric resistor 20 (the resistor 63B)→the output. In this case, the movable electric resistor 20 (the resistor 61B) and the movable electric resistor 20 (the resistor 63B) become narrow, and the movable electric resistor 20 (the resistor 62B) becomes wide. Thereby the diversion ratio becomes large and the circuit works as a fine attenuator. Referring to FIG. 10B, the resistor 61B, the resistor 62B and the resistor 63B are electrically coupled and the resistor 61A, the resistor 62A and the resistor 63A become electrically open. The power is transmitted from the input through the resistor 61B and the resistor 63B to the output. The power is partially diverged through the resistor 62B and causes a loss of the electric current.

The impedance of the input and the output is assumed as 50Ω series in this embodiment. It is preferred that a resistor whose specific resistance per unit area is lowered be used as the movable electric resistor 20 of the MEMS switch 10. Such resistor includes resistors made from a polysilicon in which tungsten silicide is formed or a low-resistance polysilicon with a high doping concentration. The value of the specific resistance per unit area can be adjusted to for example about 10 $\Omega/m^2$. In this way, the resistor will become an appropriate resistor for the 50Ω series attenuation circuit.

The T-type variable attenuator 60 includes a 3 dB attenuation circuit which is used for curbing the reflection caused by the impedance mismatching and a 10 dB attenuation circuit which is used for decreasing the energy level of the inputted high-frequency signal by a digit. The 3 dB attenuation circuit and the 10 dB attenuation circuit are provided in parallel and the MEMS switch 10 changes over from one to the other according to the intended use. Where the "ATT" is "0" (OFF) and the "ATT-bar" is "1" (ON), the 3 dB attenuation circuit can be realized by setting the resistance value of the resistor 61A and the resistor 63A to 9Ω and setting the resistance value of the resistor 62A to 140Ω. The 10 dB attenuation circuit can be realized by setting the resistance value of the resistor 61B to 26Ω and setting the resistance value of the resistor 62B to 35Ω.

Where the attenuation of the inputted signal is switched over by using the T-type variable attenuator 60, one attenuation circuit is used and the other attenuation circuit becomes open. For example, the 10 dB attenuation circuit is open if the 3 dB attenuation circuit is used. In this case, the high-frequency signal can be reflected by the 10 dB attenuation circuit and this can deteriorates the quality of the attenuator. However, the MEMS switch 10 itself can serves as an attenuator according to the embodiments so that the Q value can remain small and the high-frequency signal penetrating to the switch will be attenuated. Accordingly, the reflection of the high-frequency signal can be efficiently prevented and this makes it possible to fabricate the T-type variable attenuator 60 with a fine transmissibility.

Figure 11A:
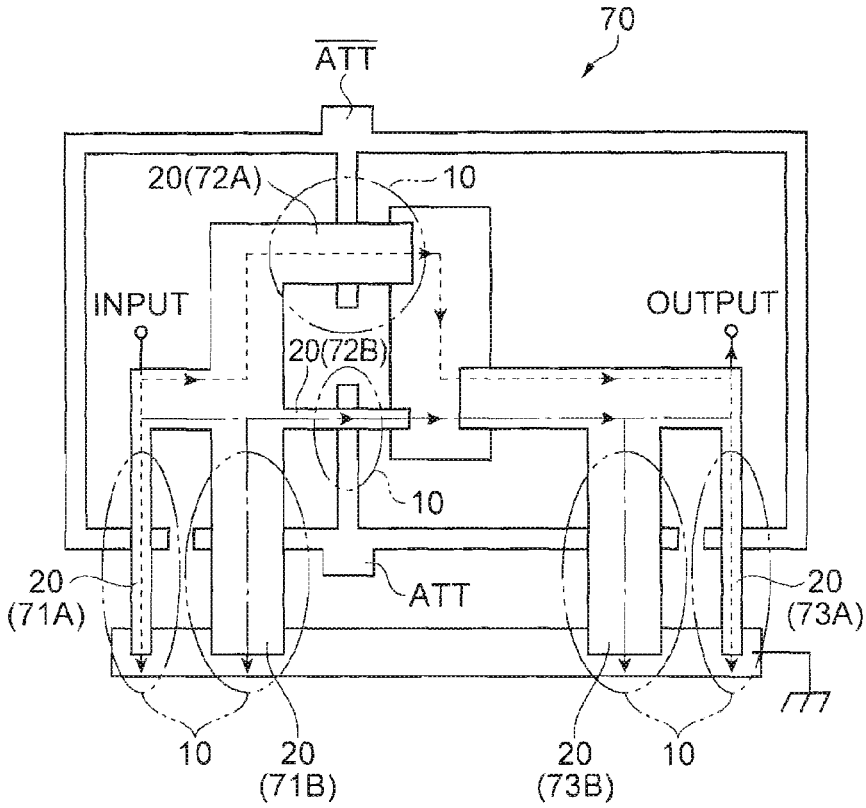
FIG. 11A is a schematic plan view of a π-type variable attenuator and FIG. 11B is an equivalent circuit schematic diagram of the π-type variable attenuator.
Figure 11B:
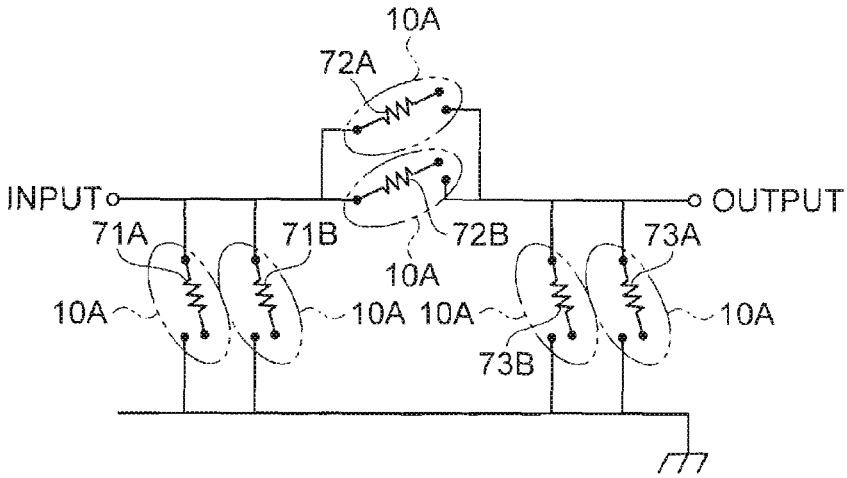

Though the T-type circuit for the T-type variable attenuator has been described, the embodiment can be applied to a π-type structure. FIG. 11A is a schematic plan view of a π-type variable attenuator 70. FIG. 11B is an equivalent circuit schematic diagram of the π-type variable attenuator 70.

Control signal with the opposite phase is respectively supplied to the "ATT" and the "ATT-bar". The "ATT-bar" is "1" (ON) when the "ATT" is "0" (OFF). In this case, the inputted signal travels through the path designated by the dashed line shown in the drawing and is transmitted to the output.

The inputted signal is transmitted through the following path: the input→a part of the signal diverges into the movable electric resistor 20 (a resistor 71A)→the movable electric resistor 20 (a resistor 72A)→a part of the signal diverges into the movable electric resistor 20 (a resistor 73A)→the output. In this case, the movable electric resistor 20 (the resistor 71A) and the movable electric resistor 20 (the resistor 73A) are formed to have a small width, and the movable electric resistor 20 (the resistor 72A) is formed to have a large width. Thereby the loss by the divergence is small. The signal inputted from the input can be transmitted to the output with a small loss. Referring to FIG. 11B, the resistor 71A, the resistor 72A and the resistor 73A are electrically coupled, and a resistor 71B, a resistor 72B and a resistor 73B become electrically open. The power is transmitted from the input through the resistor 72A to the output. The power is partially diverged through the resistor 71A and the resistor 73A and causes a loss of the electric current.

When the "ATT" is "1" (ON) and the "ATT-bar" is "0" (OFF), the inputted signal travels through the path designated by the alternate long and short dashed line shown in the drawing and is transmitted to the output. The inputted signal is transmitted through the following path: the input→a part of the signal diverges into the movable electric resistor 20 (the resistor 71B)→the movable electric resistor 20 (the resistor 72B)→a part of the signal diverges into the movable electric resistor 20 (the resistor 73B)→the output. In this case, the movable electric resistor 20 (the resistor 71B) and the movable electric resistor 20 (the resistor 73B) become wide, and the movable electric resistor 20 (the resistor 72B) becomes wide. Thereby the diversion ratio becomes large and the circuit works as a fine attenuator. Referring to FIG. 11B, the resistor 71B, the resistor 72B and the resistor 73B are electrically coupled, and the resistor 71A, the resistor 72A and the resistor 73A become electrically open. The power is transmitted from the input through the resistor 72B to the output. The power is partially diverged through the resistor 71B and the resistor 73B and causes a loss of the electric current.

Figure 12:
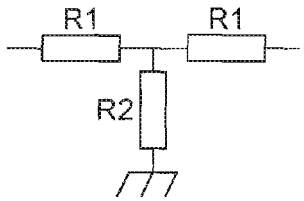
FIG. 12 shows a table of theoretical values of the attenuation and the resistance respectively for the 50Ω-series T-type and the 50Ω-series π-type.
Figure 12:
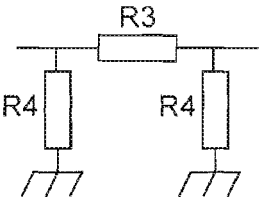

FIG. 12 shows a table of theoretical values of the attenuation and the resistance respectively for the 50 Ω-series T-type and the 50 Ω-series π-type. The switchable T-type and π-type attenuator circuit can be obtained when the value shown in the table is adopted. The π-type attenuator circuit according to the above-mentioned embodiment can also curb the Q value in the same way as the T-type circuit so that the reflection from the open MEMS switch 10 can be prevented.

Though the 50 Ω-series attenuator has been described in the above embodiments, the embodiments can be applied to a 75 Ω-series by changing the resistance value. In the case of the T-type, the circuit having the functions of both the attenuator and the impedance conversion can be obtained by deferring the resistance value of the resistor 61 provided on the input side from the resistance value of the resistor 61 provided on the output side. In this way, it is possible to offer the attenuator having the switching function for example switching into 50 Ω-series/75 Ω-series or into 75 Ω-series/50 Ω-series. In the same manner, it is possible for the π-type attenuator circuit to form the circuit having the functions of both the attenuator and the impedance conversion by deferring the resistance value of the input side from that of the output side.

What is claimed is:

1. A micro-electro mechanical system switch, comprising:

a fixed electrode formed on a substrate;

a movable electric resistor formed on the substrate and having one end fixed to the substrate by a support portion of the movable electric resistor, the movable electric resistor and the fixed electric resistor being formed of a same layer, the moveable electrode resistor directly separating from and contacting the fixed electrode;

a fixed electric resistor, formed on the substrate, having one end connected to the support portion of the movable electric resistor; and an output portion connected to the support portion of the movable electric resistor;

when the movable electric resistor and the fixed electrode are set in a conductive state, a potential applied between the fixed electrode and another end of the fixed electric resistor being distributed according to a ratio of a resistance value of the fixed electric resistor and a resistance value from the one end to the other end of the movable electric resistor and being output to the output portion, and in a state when no voltage is applied, the movable electric resistor being parallel to the fixed electrode.

2. The micro-electro mechanical system switch according to claim 1, further comprising:

a projection attached to or integrally formed with the movable electric resistor, the projection extending in a projection direction towards the fixed electrode.

3. The micro-electro mechanical system switch according to claim 2, the projection being strip-shaped.

4. The micro-electro mechanical system switch according to claim 2, the projection being sword-shaped.

5. The micro-electro mechanical system switch according to claim 2, the projection being a plurality of point contact shapes.

6. The micro-electro mechanical system switch according to claim 1, wherein the movable electric resistor is formed by a single layer.

7. The micro-electro mechanical system switch according to claim 1, wherein the movable electric resistor is formed of a single material.

8. A micro-electro mechanical system switch comprising:

a fixed electrode formed on a substrate;

a movable electric resistor formed on the substrate and having one end fixed to the substrate by a support portion of the moveable electric resistor, the movable electric resistor and the fixed electric resistor being formed of a same layer, the moveable electrode resistor directly separating from and contacting the fixed electrode;

a fixed electric resistor, formed on the substrate, having one end connected to the support portion of the movable electric resistor; and an output portion connected to the support portion of the movable electric resistor;

when the movable electric resistor and the fixed electrode are set in a conductive state, a potential applied between the fixed electrode and another end of the fixed electric resistor being distributed according to a ratio of a resistance value of the fixed electric resistor and a resistance value from the one end to the other end of the movable electric resistor and being output to the output portion, and in a state when no voltage is applied, the movable electric resistor being parallel to the fixed electrode, the fixed electric resistor and the movable electric resistor being formed from an identical layer.

9. The micro-electro mechanical system switch according to claim 8, the identical layer being formed of polysilicon.

10. The micro-electro mechanical system switch according to claim 8, the identical layer being formed of a silicide layer formed on a polysilicon layer.

11. The micro-electro mechanical system switch according to claim 8, the fixed electric resistor and the movable electric resistor forming a voltage-dividing circuit.

12. The micro-electro mechanical system switch according to claim 8, the fixed electric resistor and the movable electric resistor forming a gain control circuit.

13. The micro-electro mechanical system switch according to claim 8, the fixed electric resistor and the movable electric resistor forming at least one of an attenuator for a high-frequency signal or an impedance converter.

14. A micro-electro mechanical system switch comprising:

a fixed electrode formed on a substrate;

a movable electric resistor, formed on the substrate, having one end fixed to the substrate by a support portion of the movable electric resistor, the movable electric resistor and the fixed electric resistor being formed of a same layer, the movable electric resistor directly separating from and contacting the fixed electrode;

a driving electrode, formed on the substrate, that electrically closes and opens the movable electric resistor and the fixed electrode by generating an electrostatic force between the driving electrode and the moveable electric resistor;

a fixed electric resistor, formed on the substrate, having one end connected to the support portion of the movable electric resistor; and an output portion that is connected to the support portion of the movable electric resistor;

when the movable electric resistor and the fixed electrode are set in a conductive state, a potential applied between the fixed electrode and another end of the fixed electric resistor being distributed according to a ratio of a resistance value of the fixed electric resistor and a resistance value from the one end to the other end of the movable electric resistor and being output to the output portion, and in a state when no voltage is applied, the movable electric resistor being parallel to the fixed electrode.

15. The micro-electro mechanical system switch according to claim 14, the movable electric resistor including a protrusion, the protrusion being provided so as to contact the fixed electrode when the force is created between the driving electrode and the fixed electrode.

16. The micro-electro mechanical system switch according to claim 14, the micro-electro mechanical system switch further comprising a supporting member that supports the movable electric resistor.

17. The micro-electro mechanical system switch according to claim 14, wherein the movable electric resistor is formed by a single layer.

18. The micro-electro mechanical system switch according to claim 14, wherein the movable electric resistor is formed of a single material.

19. A micro-electro mechanical system switch comprising:

a fixed electrode formed on a substrate;

a movable electric resistor, formed on the substrate, having one end fixed to the substrate by a support portion of the movable electric resistor, the movable electric resistor and the fixed electric resistor being formed of a same layer, the movable electric resistor directly separating from and contacting the fixed electrode;

a driving electrode, formed on the substrate, that electrically closes and opens the movable electric resistor and the fixed electrode by generating an electrostatic force between the driving electrode and the moveable electric resistor;

a fixed electric resistor, formed on the substrate, having one end connected to the support portion of the movable electric resistor; and an output portion that is connected to the support portion of the movable electric resistor;

when the movable electric resistor and the fixed electrode are set in a conductive state, a potential applied between the fixed electrode and another end of the fixed electric resistor being distributed according to a ratio of aresistance value of the fixed electric resistor and a resistance value from the one end to the other end of the movable electric resistor and being output to the output portion, and in a state when no voltage is applied, the movable electric resistor being parallel to the fixed electrode, the fixed electric resistor and the movable electric resistor being integrally formed.

20. The micro-electro mechanical system switch according to claim 19, further comprising:

a filling layer, the fixed electric resistor being place on the filling layer.

* * * * *